US008151891B1

(12) United States Patent
Darnell et al.

(10) Patent No.: US 8,151,891 B1
(45) **Date of Patent: *Apr. 10, 2012**

(54) FORMATION SAVER SUB AND METHOD

(75) Inventors: William J. Darnell, Houston, TX (US); Charles D. Wintill, Houston, TX (US); Rodney W. Long, Cypress, TX (US)

(73) Assignee: PetroQuip Energy Services, LP, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/038,767

(22) Filed: Mar. 2, 2011

Related U.S. Application Data

(63) Continuation of application No. 12/221,596, filed on Aug. 5, 2008, now Pat. No. 7,921,922.

(51) Int. Cl.
*E21B 43/00* (2006.01)
*E21B 34/10* (2006.01)

(52) U.S. Cl. ..... 166/374; 166/168; 166/328; 166/383

(58) Field of Classification Search ..... 166/383, 166/319, 374, 320, 327, 328, 168
See application file for complete search history.

(56) References Cited

U.S. PATENT DOCUMENTS

| | | | | |
|---|---|---|---|---|
| 3,090,442 | A | 5/1963 | Cochran et al. | |
| 3,845,815 | A | 11/1974 | Garwood | |
| 4,114,694 | A | 9/1978 | Dinning | |
| 4,487,221 | A | 12/1984 | Zwart | |
| 4,510,994 | A | 4/1985 | Pringle | |
| 4,917,191 | A | 4/1990 | Hopmann et al. | |
| 5,012,867 | A | 5/1991 | Kilgore | |
| 5,174,379 | A | 12/1992 | Whitely et al. | |
| 5,183,114 | A | 2/1993 | Mashaw et al. | |
| 5,305,828 | A | 4/1994 | White et al. | |
| 5,511,617 | A | 4/1996 | Snider et al. | |
| 5,826,652 | A | 10/1998 | Tapp | |
| 5,921,318 | A | 7/1999 | Ross | |
| 5,960,879 | A | 10/1999 | Echols | |
| 6,866,100 | B2 | 3/2005 | Gudmestad et al. | |
| 7,921,922 | B2 * | 4/2011 | Darnell et al. | 166/374 |

OTHER PUBLICATIONS

Co-pending U.S. Appl. No. 12/221,596, filed Aug. 5, 2008.

* cited by examiner

*Primary Examiner* — Jennifer H Gay
(74) *Attorney, Agent, or Firm* — Jones Walker

(57) ABSTRACT

A formation saver sub or pump out sub incorporating an anti-surge feature. The sub includes a body, a mandrel, a piston (or an annulus fluid pressure chamber and a tubular pressure chamber), a sleeve, a spring, a releasable seat, and a plug. The plug and seat are released from the sub when one or more dogs releasably positioning the seat in the mandrel bore disengages from the seat due to a bleed off of fluid pressure in the well bore.

19 Claims, 15 Drawing Sheets

FORMATION SAVER SUB AND METHOD

CROSS-REFERENCE TO RELATED APPLICATIONS

This application is a continuation of U.S. patent application Ser. No. 12/221,596, filed Aug. 5, 2008, now issued as U.S. Pat. No. 7,921,922, which is incorporated herein by reference.

FIELD OF THE INVENTION

The present invention relates to a formation saver sub and method for sealing well tubing so that pump out pressure may be achieved to actuate a well tool, and more particularly to a formation saver sub that incorporates an anti-surge feature.

BACKGROUND OF THE INVENTION

In oil or gas wells, well tools, such as hydraulic packers, are manipulated by fluid pressure in the well tubing. To obtain increased pressures in the well tubing, a pump out sub is used that plugs the well tubing so that pressure may be increased to actuate the well tool. The pump out sub contains a seat that receives a plug, such as a ball or dart, which is dropped down the well tubing. After actuation of the well tool, the plug is dislodged from the seat by increasing fluid pressure to a level that a shear pin holding the seat in place is sheared. The seat moves downward within the well tubing and the plug is disassociated therefrom passing downward through and out of the well tubing. An example of a pump out sub is described in U.S. Pat. No. 4,510,994, issued Apr. 16, 1985, which is incorporated herein by reference.

Conventional pump out subs are susceptible to formation surge because of the differential pressures that must be used to release the plug. Accordingly, there is a need for an improved pump out sub that reduces or eliminates formation surge.

SUMMARY OF THE INVENTION

It is an object of the present invention to provide a pump out sub that contains an anti-surge feature.

It is a further object of the present invention to provide a pump out sub with the capability of bleeding off well tubing pressure before releasing the plug and seat.

It is a further object of the present invention to provide a pump out sub with a backup contingency feature that permits the shearing of the dog system to release the plug and seat.

It is a further object of the present invention to provide a pump out sub with a small outer diameter capable of accommodating dual packer applications.

It is a further object of the present invention to provide a pump out sub capable of using both a ball or dart system for plugging the well tubing.

It is a further object of the present invention to provide a pump out sub capable of causing multiple pressure increases within the well tubing to actuate a well tool or tools.

It is a further object of the present invention to provide a pump out sub capable of causing different pressure increases within the well tubing to manipulate a well tool or tools.

The objects of the present invention are achieved by the novel formation saver sub of the present invention that has a tubular body including an upper section, a middle section, a lower section, an outer surface, and an inner surface. The upper section of the body is adapted for connection to the well tubing. The upper section of the body may be threadedly connected to the well tubing. The well tubing has a well bore.

The sub also includes a mandrel having an upper section, a middle section, a lower section, an outer surface and an inner surface defining a mandrel bore. The upper section of the mandrel is adapted for connection to the well tubing. The upper section of the mandrel may be threadedly connected to the well tubing. The mandrel is positioned interior of the body. When the sub is assembled and connected to the well tubing, the well bore and the mandrel bore are in alignment.

The sub further includes a piston having an upper section, a middle section, a lower section, an outer surface, and an inner surface. The piston is positioned between the inner surface of the body and the outer surface of the mandrel. The piston may include a fluid chamber. The mandrel may also include a passage for fluid communication between the mandrel bore and the fluid chamber of the piston.

Also included in the sub is a sleeve having an upper section, a middle section, a lower section, an outer surface and an inner surface. The sleeve is connected to the piston. The sleeve may be threadedly connected to the piston. The sleeve is positioned between the inner surface of the body and the outer surface of the mandrel.

The sub further has a shear means detachably affixing the sleeve to the mandrel. The shear means may be one or more shear pins, screws, or rings.

A seat is also part of the sub and includes an upper section, a middle section, a lower section, an outer surface, and an inner surface defining a seat bore. The seat is releasably positioned in the mandrel bore. The upper section of the seat is adapted to receive a plug. The plug may be a ball or dart.

The sub further includes a spring means positioned between the inner surface of the body and the outer surface of the mandrel. The spring means cooperatively engages with the piston.

The formation saver sub of the present invention is used in a method of actuating a well tool connected to the well tubing. The process includes connecting the formation saver sub to the well tubing below the well tool. The well bore above the seat of the sub is plugged or sealed by dropping the plug through the well bore to the mandrel bore where the plug seats in the upper section of the seat. The well tool can be manipulated by increasing fluid pressure in the well bore to activate and deactivate the well tool. After operations involving the well tool are completed, it is desirable to unplug or unseal the well bore by removing the plug and seat.

Unplugging is accomplished by activating the piston of the sub by increasing the fluid pressure in the well bore to a level that causes: (1) the shearing of the shear means to detach the sleeve from the mandrel; and (2) upward movement of the piston and sleeve resulting in the compression of the spring means. Thereafter, the process involves deactivating the piston by bleeding off the fluid pressure in the well bore to a level that causes: (1) expansion of the spring means; and (2) downward movement of the piston and sleeve to a position that results in the release of the seat from the mandrel bore.

The level of fluid pressure in the well bore sufficient to shear the shear means is in the range of 500 PSI to 15,000 PSI, and more particularly, in the range of 1,500 PSI to 10,000 PSI. The bleed off level of fluid pressure in the well bore sufficient to deactivate the piston is in the range of 100 PSI to 1,000 PSI, and more particularly, is about 500 PSI.

In a further embodiment of the present invention, at least one retractable dog is supported in the mandrel. The dog includes a first end and a second end. The first end of the dog releasably engages the seat to position the seat in the mandrel bore prior to deactivation of the piston as described above.

The deactivation of the piston causes the first end of the dog to disengage from the seat to release the seat from the mandrel bore.

In this further embodiment, the mandrel may include a bore-hole with an inner-surface opening and an outer-surface opening. The bore-hole supports the retractable dog. A portion of the inner surface of the sleeve covers the outer-surface opening of the bore-hole in the mandrel prior to deactivation of the piston.

The mandrel may also include biasing means (e.g., springs) positioned in the bore-hole of the mandrel. The biasing means bias the second end of the dog against the portion of the inner surface of the sleeve covering the outer-surface opening of the bore-hole in the mandrel prior to deactivation of the piston. Deactivation of the piston by bleeding off the fluid pressure in the well bore causes expansion of the spring means and downward movement of the piston and sleeve to a position wherein the portion of the inner surface of the sleeve no longer covers the outer-surface opening of the bore-hole in the mandrel; instead, the fluid chamber in the piston now sets adjacent the outer-surface opening of the bore-hole in the mandrel. The biasing means causes the second end of the dog to enter into the chamber of the piston through the outer-surface opening of the bore-hole in the mandrel and the first end of the dog to disengage from the seat and retract into the bore-hole of the mandrel, which releases the seat from the mandrel bore.

The outer surface of the seat in this further embodiment of the present invention may include a recess for engagement of the first end of the dog when the seat is releasably positioned in the mandrel bore. Also, the inner surface of the seat in the upper section may be tapered to accommodate the plug. The seat bore may further include a first bore section and a second bore section. The first bore section may have a larger bore diameter than the second bore section. Seating of the plug in the larger bore section plugs, seals, or blocks the smaller second bore section effectively plugging or sealing the well bore above the seat.

In an alternative embodiment, the formation saver sub has a tubular body including an upper section, a middle section, a lower section, an outer surface, and an inner surface. The sub also includes a mandrel with an upper section, a middle section, a lower section, an outer surface and an inner surface defining a mandrel bore. The mandrel is positioned interior of the body. The sub contains a piston including an upper section, a middle section, a lower section, an outer surface, and an inner surface. The piston is positioned between the inner surface of the body and the outer surface of the mandrel. The sub also has a seat including an upper section, a middle section, a lower section, an outer surface, and an inner surface defining a seat bore. The seat is releasably positioned in the mandrel bore. The upper section of the seat adapted to receive a plug.

In this alternative embodiment, the piston is actuated in a first direction in response to an increase in fluid pressure (e.g., well tubing pressure). Actuation of the piston in the first direction maintains the positioning of the seat in the mandrel bore. The piston is also actuated in a second direction in response to a bleed off of the fluid pressure. Actuation of the piston in the second direction releases the seat from the mandrel bore.

Also in the alternative embodiment the upper section of the tubular body is adapted for connection to well tubing. The well tubing includes a well bore. The upper section of the mandrel is also adapted for connection to the well tubing.

The alternative embodiment may contain an annulus port in the tubular body. The annulus port is fluidly connected to an annulus pressure chamber. The annulus pressure chamber is positioned between the inner surface of the body and the outer surface of the mandrel. An atmospheric pressure chamber is positioned between the inner surface of the body and the outer surface of the mandrel.

The piston is the alternative embodiment may have a tubing pressure chamber. In addition, the sub may include a sleeve having an upper section, a middle section, a lower section, an outer surface and an inner surface. The sleeve is connected to the piston. The sleeve is positioned between the inner surface of the body and the outer surface of the mandrel. The sub may further contain a shear means detachably affixing the sleeve to the mandrel. The annulus pressure chamber and the atmospheric pressure chamber are separated by the piston and sleeve.

In the alternative embodiment, the piston is actuated by increasing tubing pressure in the tubing pressure chamber to a predetermined level that exerts sufficient force on the piston to shear the shear means. Once the shear means are sheared, the sleeve is detached from the mandrel. The increased tubing pressure forces the piston and sleeve to move upward into the annulus pressure chamber. The bleed off of tubing pressure to a level less than the annulus pressure level causes actuation of the piston in a second direction. The annulus pressure in the annulus chamber forces the piston and sleeve to move downward to a position that results in the release of the seat from the mandrel bore.

The alternative embodiment may also include at least one retractable dog supported in the mandrel. The dog includes a first end and a second end. The first end of the dog releasably engages the seat to position the seat in the mandrel bore prior to the actuation of the piston in the second direction. Actuation of the piston in the second direction causes the first end of the dog to disengage from the seat to release the seat from the mandrel bore to eliminate obstruction of the well bore caused by the seat and plug. The well bore obstruction is eliminated when the seat and plug fall down the well bore after being released.

The mandrel in the alternative embodiment may further include a bore-hole having an inner-surface opening and an outer-surface opening. The bore-hole supports the retractable dog. A portion of the inner surface of the sleeve covers the outer-surface opening of the bore-hole in the mandrel prior to the actuation of the piston in the second direction. The mandrel may include biasing means positioned in the bore-hole of the mandrel. The biasing means bias the second end of the dog against a portion of the inner surface of the sleeve prior to actuation of the piston in the second direction. Actuation of the piston in the second direction moves the piston and sleeve downward to a position wherein the portion of the inner surface of the sleeve no longer covers the outer-surface opening of the bore-hole in the mandrel and wherein the tubing pressure chamber in the piston sets adjacent to the outer-surface opening of the bore-hole in the mandrel. The biasing means causes the second end of the dog to enter the tubing pressure chamber of the piston through the outer-surface opening of the bore-hole in the mandrel. The first end of the dog then disengages from the seat and retracts into the bore-hole of the mandrel thereby releasing the seat from the mandrel bore. The obstruction of the well bore caused by the seat and plug is eliminated; the seat and plug fall down the well bore.

The present invention is also directed to a unique method of actuating a well tool connected to well tubing. The method involves connecting a formation saver sub to the well tubing below the well tool. The formation saver sub includes a tubular body including an upper section, a middle section, a lower section, an outer surface, and an inner surface. The sub also includes a mandrel having an upper section, a middle section, a lower section, an outer surface and an inner surface defining a mandrel bore. The mandrel is positioned interior of the body. The sub has a piston including an upper section, a middle section, a lower section, an outer surface, and an inner surface. The piston is positioned between the inner surface of the body and the outer surface of the mandrel. The sub also includes a seat with an upper section, a middle section, a lower section, an outer surface, and an inner surface defining a seat bore. The seat is releasably positioned in the mandrel bore. The upper section of the seat is adapted to receive a plug.

The method includes the step of sealing the well bore above the seat by dropping the plug through the well bore to the mandrel bore. The plug will seat in the upper section of the seat and obstruct or plug the well bore. The method further includes manipulating the well tool. Also included in the method is the step of increasing the fluid pressure in the well bore to a first level. The first level of fluid pressure causes the piston to move in a first direction while maintaining the positioning of the seat in the mandrel bore. The method further includes the step of bleeding off the fluid pressure in the well bore to a second level. The second level of fluid pressure causes the piston to move in a second direction that releases the seat from the mandrel bore thereby eliminating the well bore obstruction.

The fluid pressure may be tubing pressure. The first level of tubing pressure may be in the range of 1500 PSI to 10000 PSI (or 5000 PSI). The second level of tubing pressure may be in the range of 100 PSI to 1000 PSI. The second level of tubing pressure is preferably about 500 PSI.

In the method of the present invention, the sub may further include at least one retractable dog supported in the mandrel. The dog includes a first end and a second end. The first end of the dog releasably engages the seat to position the seat in the mandrel bore.

The method of the present invention is also drawn to an embodiment wherein in the event the seat is not released from the mandrel bore by deactivation of the piston or by actuation of the piston in the second direction (all as described above), the plug and seat may be displaced from the mandrel bore by increasing fluid pressure in the well bore to a level that causes the seat to disengage from the mandrel bore or by setting a tool down on the seat with sufficient force to disengage the seat and plug.

In the event the seat is not released from the mandrel bore as described above, the method may further include the step of increasing the fluid pressure in the well bore to a third level. The third level of fluid pressure is capable of shearing the dog. By shearing the dog, the seat is released from the mandrel bore and together with the plug, drops down the well bore eliminating any obstruction. Alternatively, the method may include the step of setting a tool down on the seat with sufficient force to shear the dog. Again, shearing the dog releases the seat from the mandrel bore. The seat and plug fall down the well bore. Obstruction of the well bore is eliminated.

DETAILED DESCRIPTION OF PREFERRED EMBODIMENTS

Figure 1A:
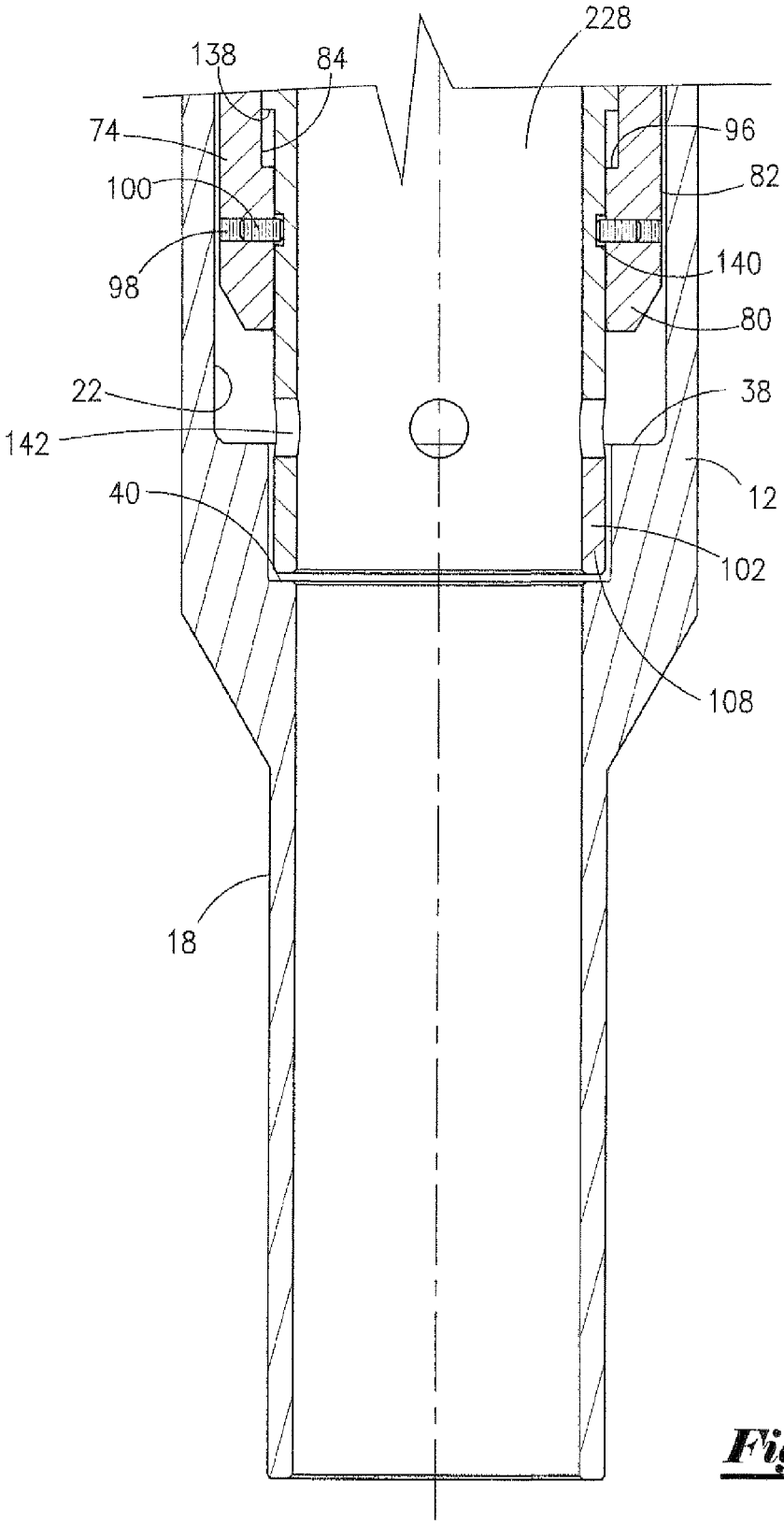
FIGS. 1A, 1B, 1C are a sequential cross-sectional side view of an embodiment of the present invention connected to the well tubing and run in down hole with the plug seated in the seat.
Figure 1B:
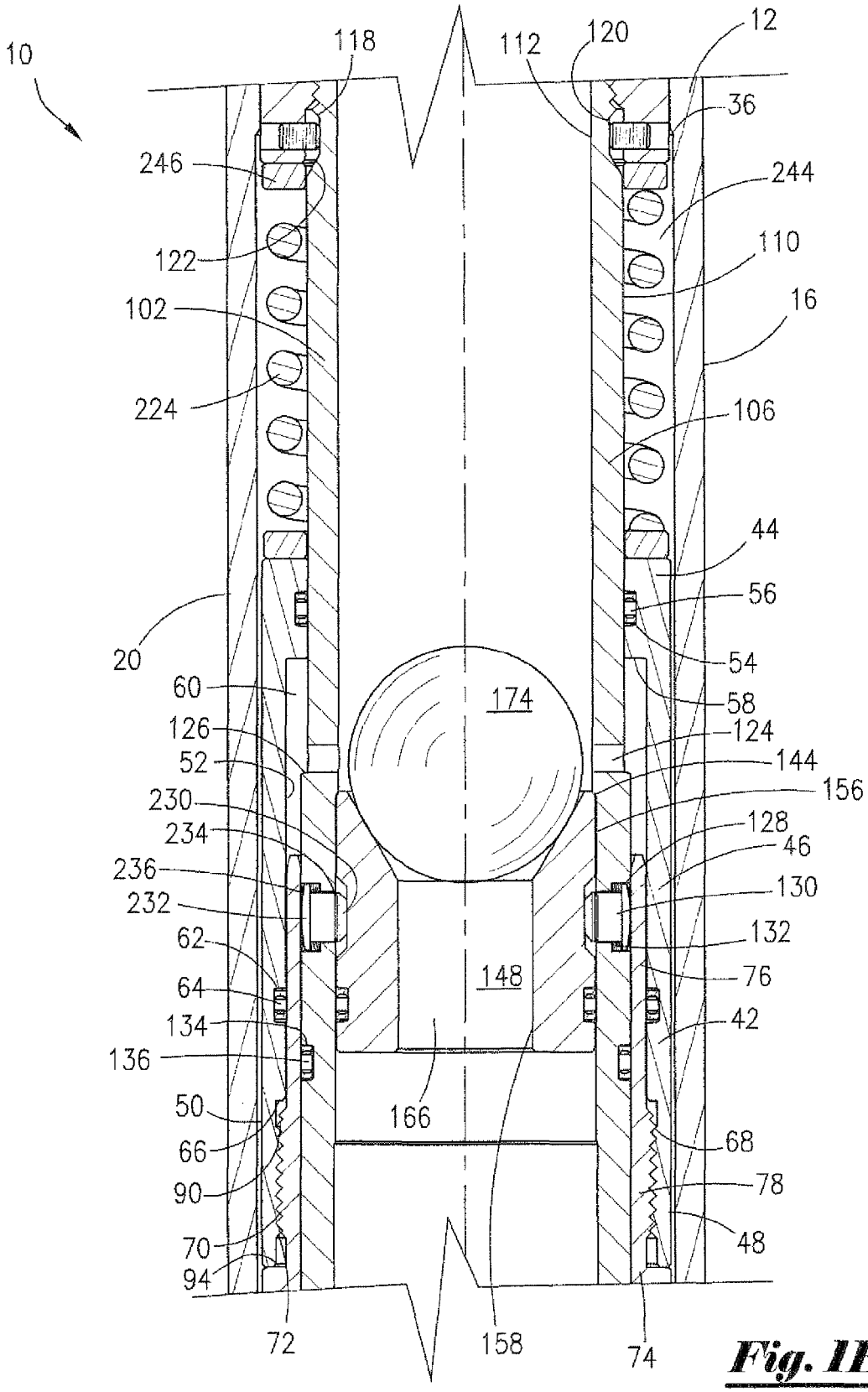
Figure 1C:
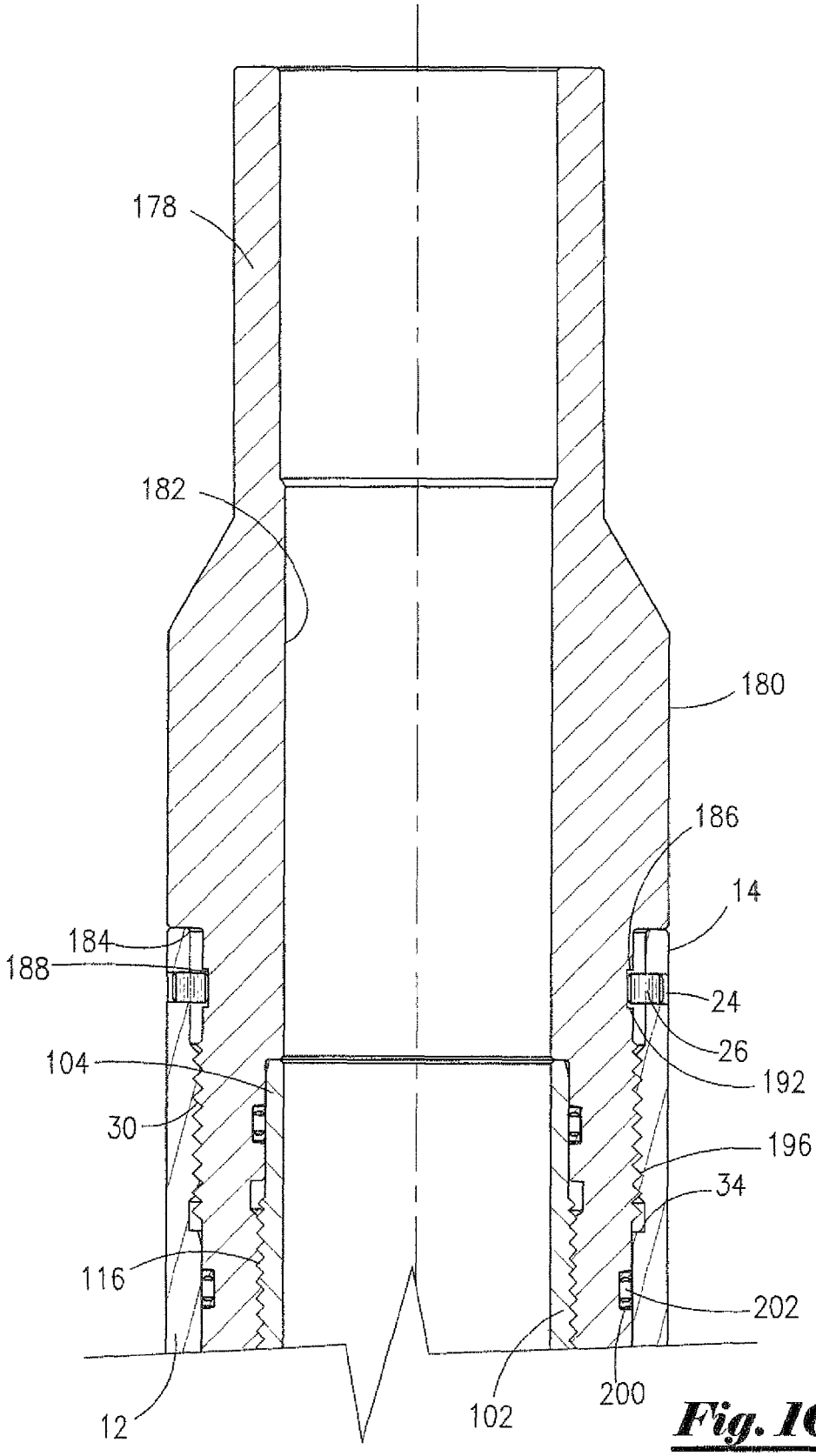

With reference to the figures where like elements have been given like numerical designation to facilitate an understanding of the present invention, and in particular with reference to the embodiment of the present invention illustrated in FIGS. 1A-1C, formation saver sub or pump out sub 10 is depicted as including body 12. Body 12 may be tubular or cylindrical. Body 12 has upper section 14, middle section 16, and lower section 18. Body 12 also has outer surface 20 and inner surface 22. Inner surface 22 of body 12 contains recess 24. Recess 24 houses set screw or pin 26. Threads 30 are also provided on inner surface 22 of body 12 in upper section 14. Inner surface 22 of body 12 contains first shoulder 34, second shoulder 36, and third shoulder 38 on inner surface 22. Fourth shoulder 40 is located in lower section 18 of body 12 on inner surface 22.

As shown in FIGS. 1A-1C, sub 10 also includes piston 42. Piston 42 has upper section 44, middle section 46, and lower section 48. Piston 42 has outer surface 50 and inner surface 52. Recess 54 is included in inner surface 52 of upper section 44. Seal 56 is also included in inner surface 52 of upper section 44. Upper section 44 also has first shoulder 58 in inner surface 52. Fluid chamber 60 is contained in upper section 44. Middle section 46 includes recess 62 in inner surface 52 that contains seal 64. Inner surface 52 in lower section 48 of piston 42 has second shoulder 66, third shoulder 68, threads 70, and fourth shoulder 72.

FIGS. 1A-1C also illustrates that sub 10 includes sleeve 74. Sleeve 74 has upper section 76, middle section 78, lower section 80, outer surface 82, and inner surface 84. Outer surface 82 of middle section 78 includes threads 90. Outer surface 82 of lower section 80 has shoulder 94. Inner surface 84 of lower section 80 contains shoulder 96 and recess 98. Recess 98 houses part of shear pin 100.

With reference to FIGS. 1A-1C, sub 10 also includes mandrel 102. Mandrel 102 has upper section 104, middle section 106, lower section 108, outer surface 110, and inner surface 112. Inner surface 112 defines mandrel bore 228. Outer surface 110 of upper section 104 has threads 116, first shoulder 118, recess 120, and second shoulder 122. Middle section 106 contains passage 124. Middle section 106 also has fourth shoulder 126 in outer surface 110. Bore-hole 128 extends through middle section 106 and supports dog 130. One or more dogs 130 (such as two to six dogs 130) may be provided. Dog 130 has first end 230 and second end 232. Bore-hole 128 has inner-surface opening 234 and outer-surface opening 236. Bore-hole 128 also houses biasing means 132. Biasing means 132 may be one or more springs such as compression springs. Biasing means 132 biases dog 130 away from mandrel bore 228 and in the direction of sleeve 74 and/or piston 42. Outer surface 110 of middle section 106 further includes recess 134. Recess 134 houses seal 136. Outer surface 110 of lower section 108 contains shoulder 138 and recess 140.

Recess 140 partially contains shear pin 100. Lower section 108 has passage 142. Inner surface 112 of middle section 106 has shoulder 144.

Again with reference to FIGS. 1A-1C, sub 10 contains spring 224 situated in chamber 244. Spring 224 is capable of compression and expansion. In FIG. 1, spring 224 is in its expanded position. Chamber 244 also contains bearings 246 that act to bear or support spring 224.

FIGS. 1A-1C and FIGS. 2A-2B reveal that sub 10 includes seat 148. Seat 148 has upper section 150, middle section 152, lower section 154, outer surface 156, and inner surface 158. Inner surface 158 defines seat bore 238. Upper section 150 includes tapered end 160 in inner surface 158. Upper section 150 also includes top edge 162. Upper section 150 of seat 148 contains first bore section 164. Middle section 152 and lower section 154 contain second bore section 166. Outer surface 156 of middle section 152 has recess 168. Recess 168 receives first end 230 of dog 130 during run-in, seating of plug 174, and activation of piston 42. Outer surface 156 of lower section 154 includes recess 170. Recess 170 houses seal 172.

As seen in FIGS. 1A-1C, sub 10 also includes plug 174. Plug 174 may be a ball or dart. As shown in FIGS. 1A-1C, plug 174 is a ball.

FIGS. 1A-1C, FIGS. 2A-2B and FIGS. 3A-3B also illustrate that sub 10 includes well tubing 178. Well tubing 178 has outer surface 180 and inner surface 182. Outer surface 180 contains first shoulder 184, second shoulder 186, and recess 188. Recess 188 houses set screw or pin 26. Outer surface 180 also has third shoulder 192, threads 196, and recess 200. Recess 200 houses first seal 202. Recess 200 may also house a second seal (not shown). Outer surface 180 further contains recess 206. Recess 206 partially houses set screw 208. Inner surface 182 includes first shoulder 210 and recess 212. Recess 212 houses seal 214. Inner surface 182 also has second shoulder 216, threads 220, and third shoulder 222. Well tubing 178 contains well bore 226. When sub 10 is connected to well tubing 178, well bore 226 and mandrel bore 228 are in alignment.

To operate sub 10, sub 10 is connected to well tubing 178 and run into a well [not shown] to a desired location as depicted in FIGS. 1A-1C. A well tool, e.g., a packer, to be manipulated is also connected to well tubing 178 above sub 10. Sub 10 may be connected to well tubing 178 by threaded connection. Threads 196 on outer surface 180 of well tubing 178 are detachably mated to threads 30 on inner surface 22 of body 12. Seal 202 (e.g., non-elastomeric or elastomeric seal rings or O-rings) seal the connection of body 12 to well tubing 178. A second seal (not shown) may be included in outer surface 180 of well tubing 178 to provide additional sealing means.

Concurrently, threads 116 on outer surface 110 of mandrel 102 are detachably mated to threads 220 on inner surface 182 on well tubing 178. Seal 214 (e.g., non-elastomeric or elastomeric seal rings or O-rings) seals the connection of mandrel 102 to well tubing 178.

When run into position in the well bore (as shown in FIGS. 1A-1C), sub 10 is configured such that piston 42 is affixed to sleeve 74. Piston 42 may be affixed to sleeve 42 by threaded connection. Threads 90 on outer surface 82 of detachable sleeve 74 are detachably mated to threads 70 on inner surface 52 of piston 42.

As seen in FIGS. 1A-1C, sleeve is detachably secured to mandrel 102 when sub 10 is run into the well. Shear pin 100 is positioned in recess 98 in sleeve 74 and extends into recess 140 in outer surface 110 of mandrel 102. Shear pin 100 acts to temporarily affix sleeve 74 to mandrel 102 until such time that shear pin 100 is sheared to release sleeve 74 as explained below. One or more (e.g., three) shear pins 100 may be provided, each being positioned in separate recesses 98 in sleeve 74 and extending into respective recesses 140 in outer surface 110 of mandrel 102.

Piston 42 contains recess 54 which houses seal 56 and recess 62 which houses seal 64. Seal 56 provides a seal between inner surface 52 of piston 42 and outer surface 110 of mandrel 102. Seal 64 provides a seal between inner surface 52 of piston 42 and outer surface 82 of sleeve 74. Seals 56 and 64 are each preferably non-elastomeric or elastomeric seal rings or O-rings.

As run in the well, sub 10 is configured with seat 148 detachably secured to inner surface 112 of mandrel 102 by dog 130. A portion of dog 130 (first end 230) is housed within recess 168 of seat 148 thus holding seat 148 stationary within mandrel bore 228. First end 230 of dog 130 is engaged within recess 168 of seat 148 due to the inability of dog 130 to be displaced by biasing means 132. Dog 130 is prevented from being disengaged due to the placement of a portion of sleeve 74 over bore-hole 128 in mandrel 102. Recess 170 in outer surface 156 of seat 148 contains seal 172 which may be an elastomeric seal ring or O-ring. Seal 172 forms a seal between outer surface 156 of seat 148 and inner surface 112 of mandrel 102.

When run into the well as shown in FIGS. 1A-1C, spring 224 is expanded due to the positioning of piston 42 in a retracted state.

After locating sub 10 in the well, the well operator will cause plug 174 to be placed in well bore 226 at the surface. Plug 174 will drop through well bore 226 to mandrel bore 228 where plug 174 seats in seat 148 as shown in FIGS. 1A-1C. Plug 174 may be a ball or dart. FIGS. 1A-1C show plug 174 as a ball. When accommodated within seat 148, plug 174 acts to plug or seal well bore 226 above seat 148 such that fluid (e.g., mud, water, etc.) pumped down well bore 226 from surface pumping equipment will not pass through seat 148 unless plug 174 and/or seat 148 are dislodged from mandrel bore 228.

With plug 174 seated in seat 148, fluid pressure in well bore 226 above seat 148 may be increased by the well operator in order to actuate and operate the well tool positioned above sub 10. For example, tubing pressure may be increased to a desired pressure to actuate a hydraulic packer. Once operations involving the well tool are completed, it may be desirable to resume fluid flow down well bore 226 pass plug 174 and seat 148. Accordingly, plug 174 and/or seat 148 must be removed from mandrel bore 228. The process of dislodging plug 174 and seat 148 from mandrel bore 228 is sequentially shown in FIGS. 2A-2C and FIGS. 3A-3C.

Figure 2A:
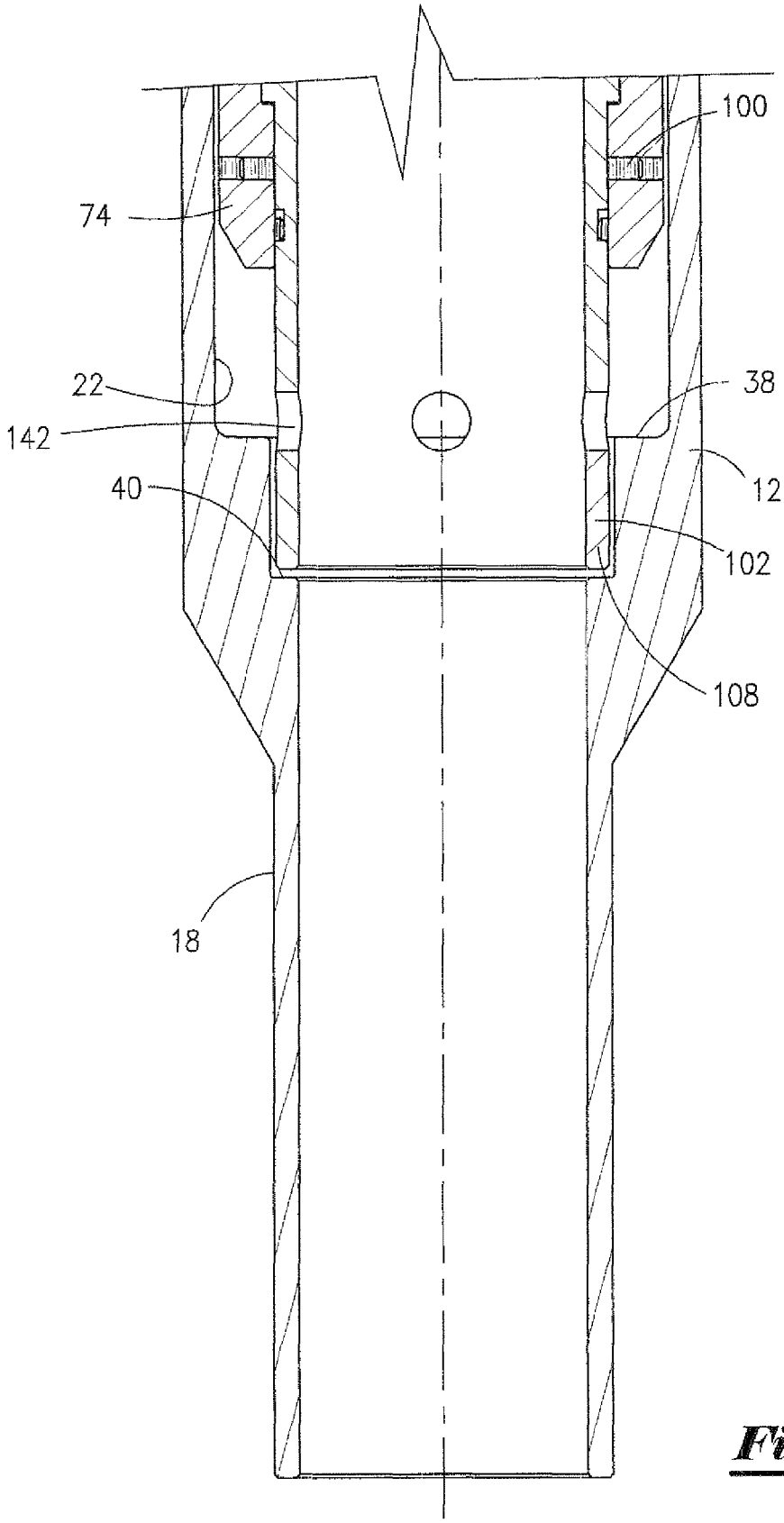
FIGS. 2A, 2B, 2C are a sequential cross-sectional side view of the embodiment of the present invention shown in FIGS. 1A-1C depicting activation of the piston.
Figure 2B:
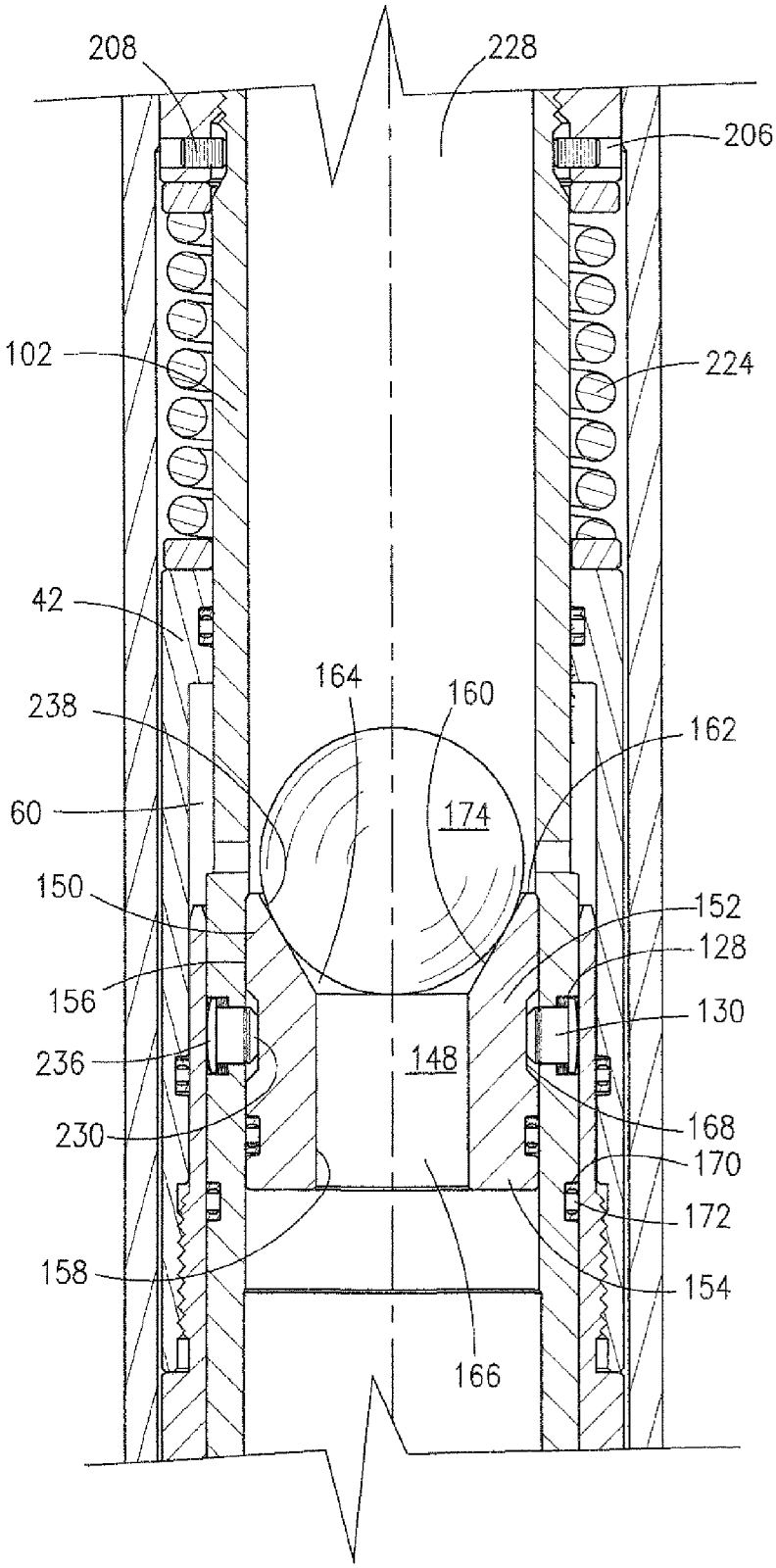
Figure 2C:
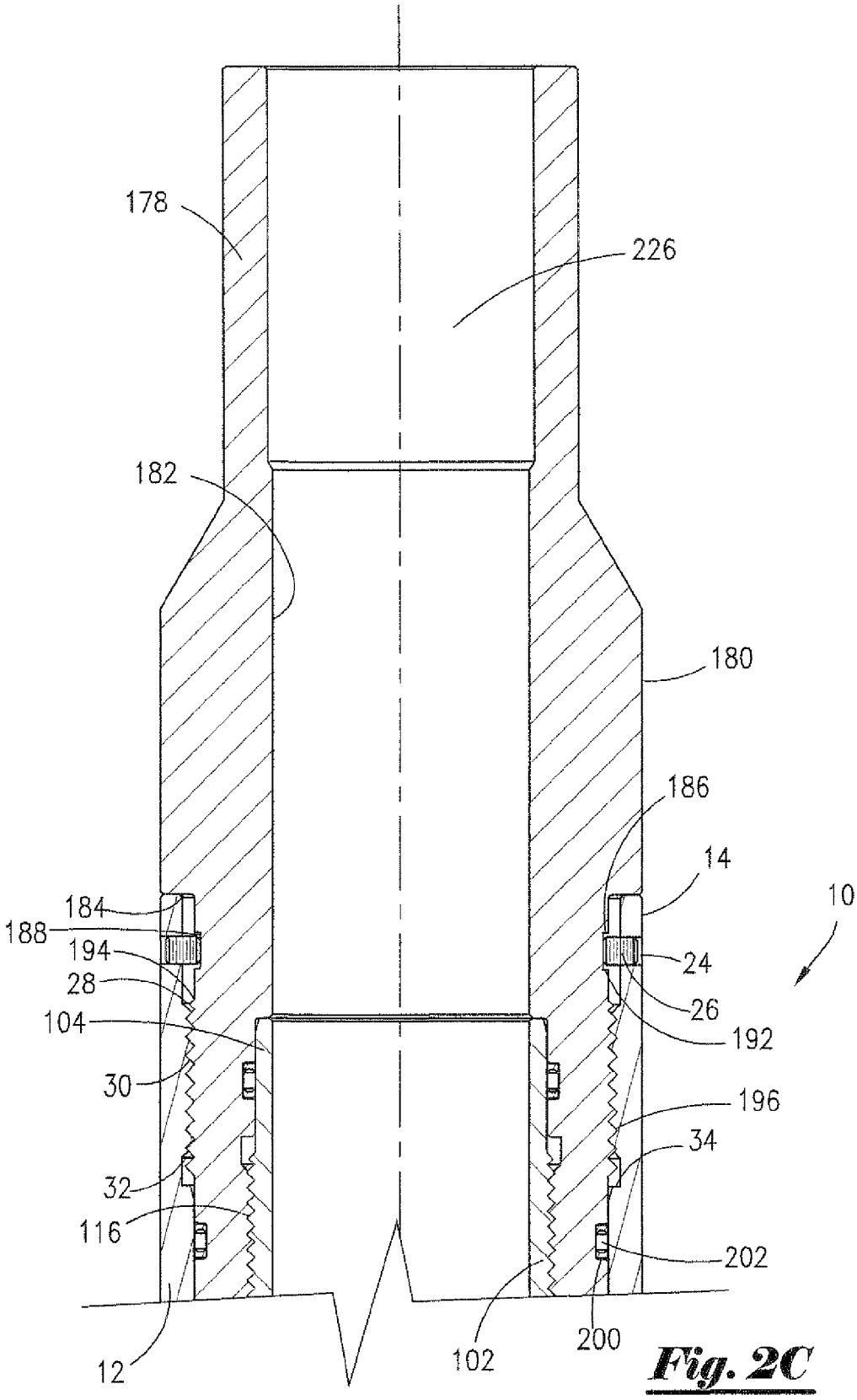

With reference to FIGS. 2A-2C, tubing pressure is increased to a predetermined level to cause the shearing of shear pin 100. Shear pin 100 is constructed to shear at a threshold pressure rating. Shearing of shear pin 100 results from fluid in well bore 226 being communicated to mandrel bore 228, through passage 124 in mandrel 102 and into chamber 60 of piston 42. When the pressure applied to piston 42 reaches the predetermined level (i.e., a level to activate piston 42), the force exerted on piston 42, and in turn to sleeve 74 connected thereto, causes shear pin 100 to shear thereby releasing sleeve 74 from mandrel 102. Piston 42 and sleeve 74 are free to slidably move. Accordingly, piston 42 is actuated by the fluid pressure being exerted thereon and moves from its retracted position to its actuated position. In the actuated position, piston 42 moves upward compressing spring 224. Because inner surface 84 of sleeve 74 (which has moved upward via its connection to piston 42) still covers and blocks outer-surface opening 236 of bore-hole 128 in mandrel 102, dog 130 remains stationary and seat 148 is held in place by engagement with first end 230 of dog 130 in recess 168 of seat 148.

Figure 3A:
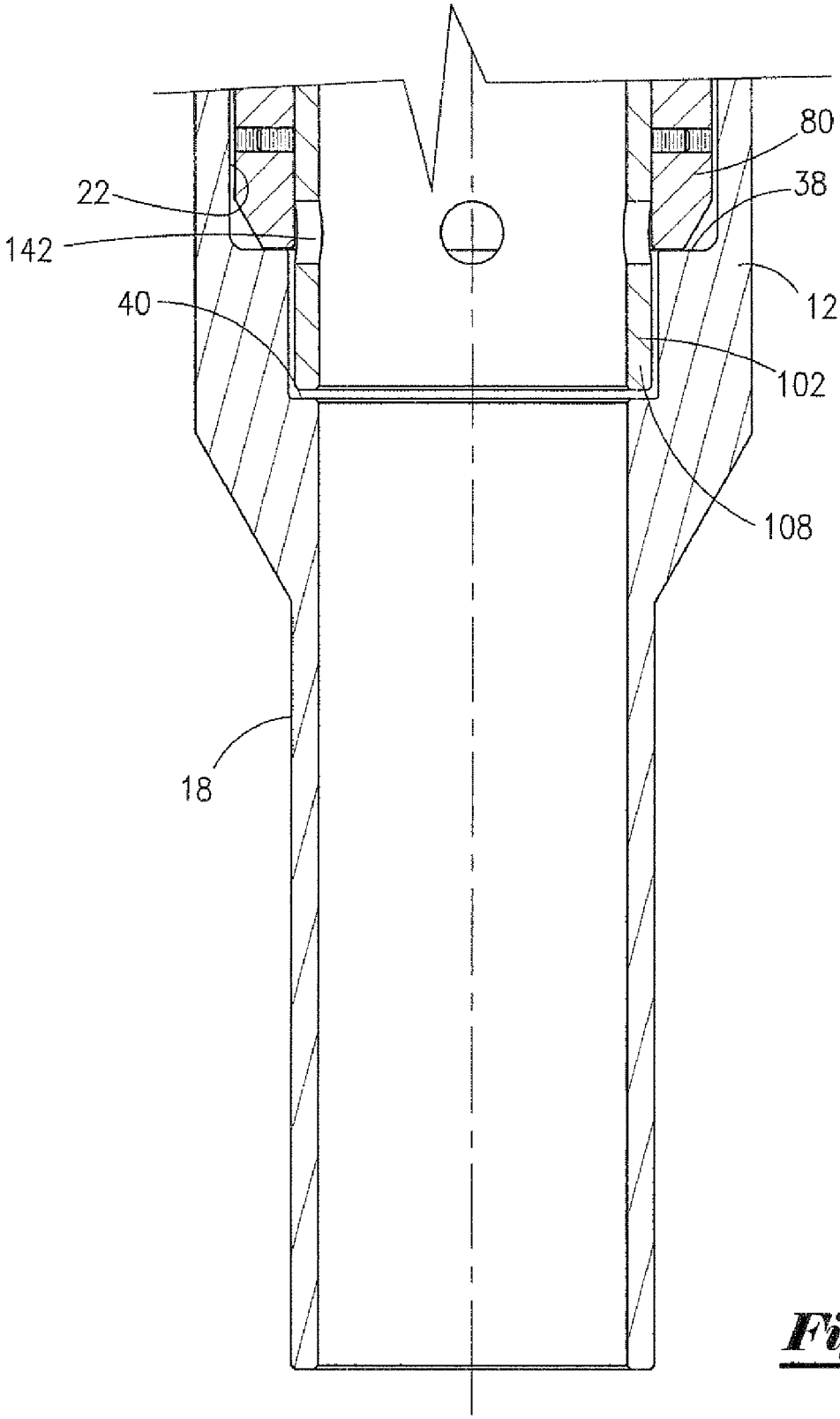
FIGS. 3A, 3B, 3C are a sequential cross-sectional side view of the embodiment of the present invention shown in FIGS. 2A-2C depicting deactivation of the piston and disengagement of the plug and seat from the mandrel bore.
Figure 3B:
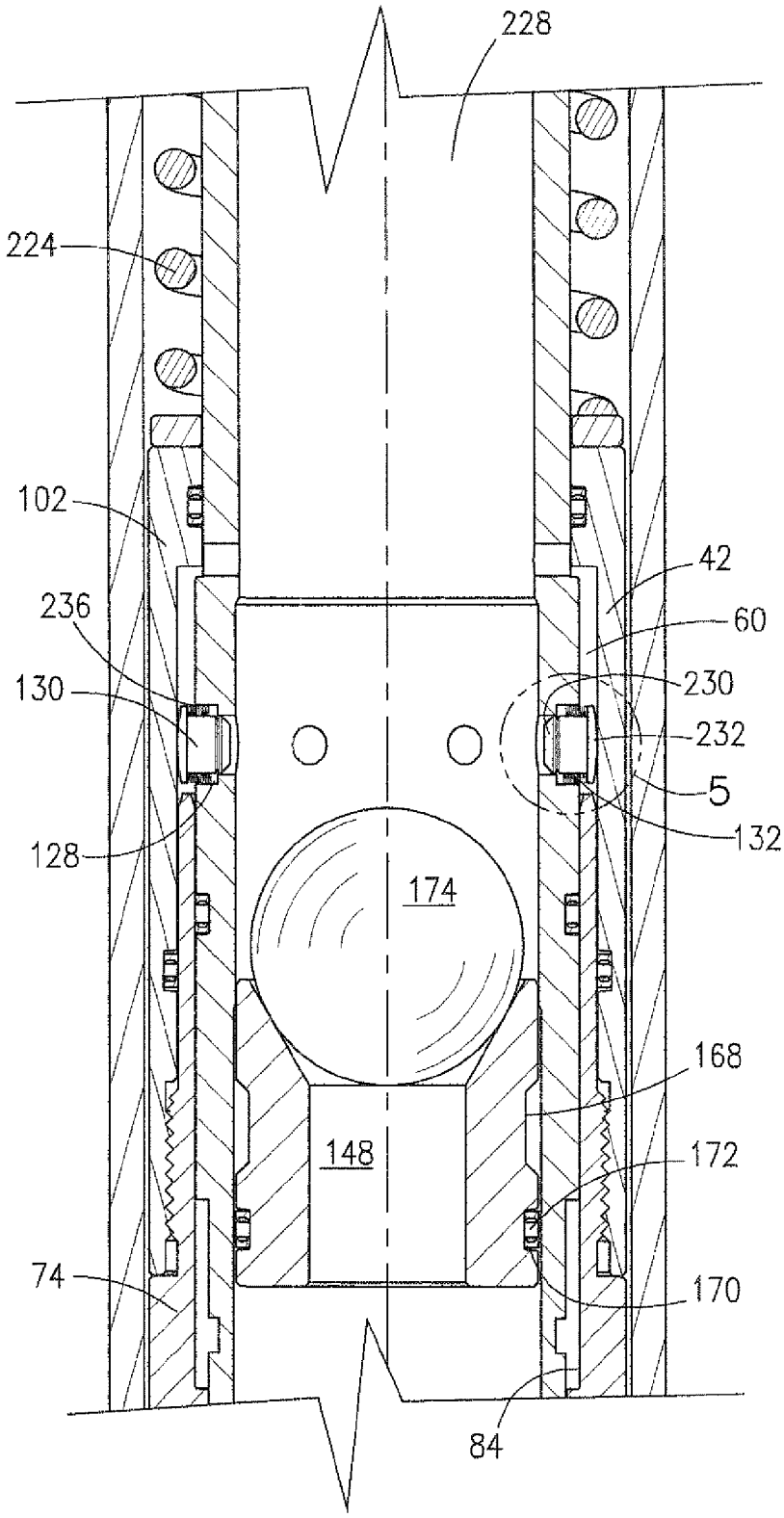
Figure 3C:
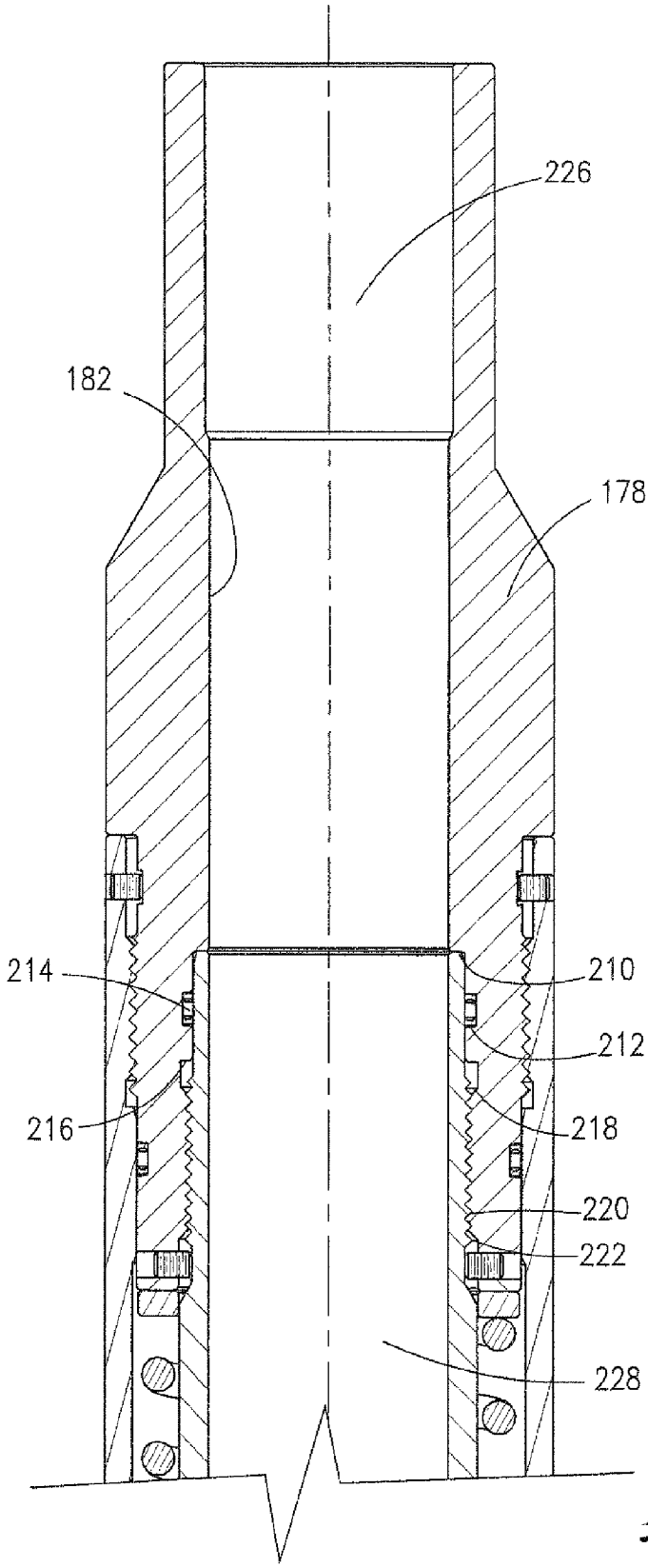

FIGS. 3A-3C show plug 174 and seat 148 released or disengaged from mandrel bore 228 and falling down mandrel bore 228 and well bore 226. Tubing pressure is bled off to a level (e.g., between 100 PSI and 1000 PSI and more particularly about 500 PSI positive tubing differential) wherein the expansion or spring force in compressed spring 224 overcomes the pressure force applied by the tubing pressure such that spring 224 expands. Expansion of spring 224 causes piston 42 and sleeve 74 connected thereto to move downward until lower section 80 of sleeve abuts against fifth shoulder 38 in lower section 18 of body 12. No portion of inner surface 84 of sleeve 74 is now blocking or covering outer-surface opening 236 of bore-hole 128 in mandrel 102 that served to prevent dog 130 from retracting to disengage first end 230 of dog 130 from recess 168 of seat 148 via biasing or spring force applied by biasing means 132 in mandrel 102.

With no impediment to disengagement, dog 130 is forced by biasing means 132 (e.g., one or more springs) to disassociate from recess 168 of seat 148. Dog 130 moves away from seat 148 and towards piston 42. Second end 232 of dog 130 moves through outer-surface opening 236 of bore-hole 128 in mandrel 102 into chamber 60 of piston 42. Seat 148 is released and falls down mandrel bore 228, well bore 226, and out of the bottom end of the well tubing. Sub 10 no longer restricts well bore 226. Dog 130 has retracted into sub 10 without obstructing mandrel bore 228 or well bore 226 and will remain there via the spring force exerted by biasing means 132.

Figure 4A:
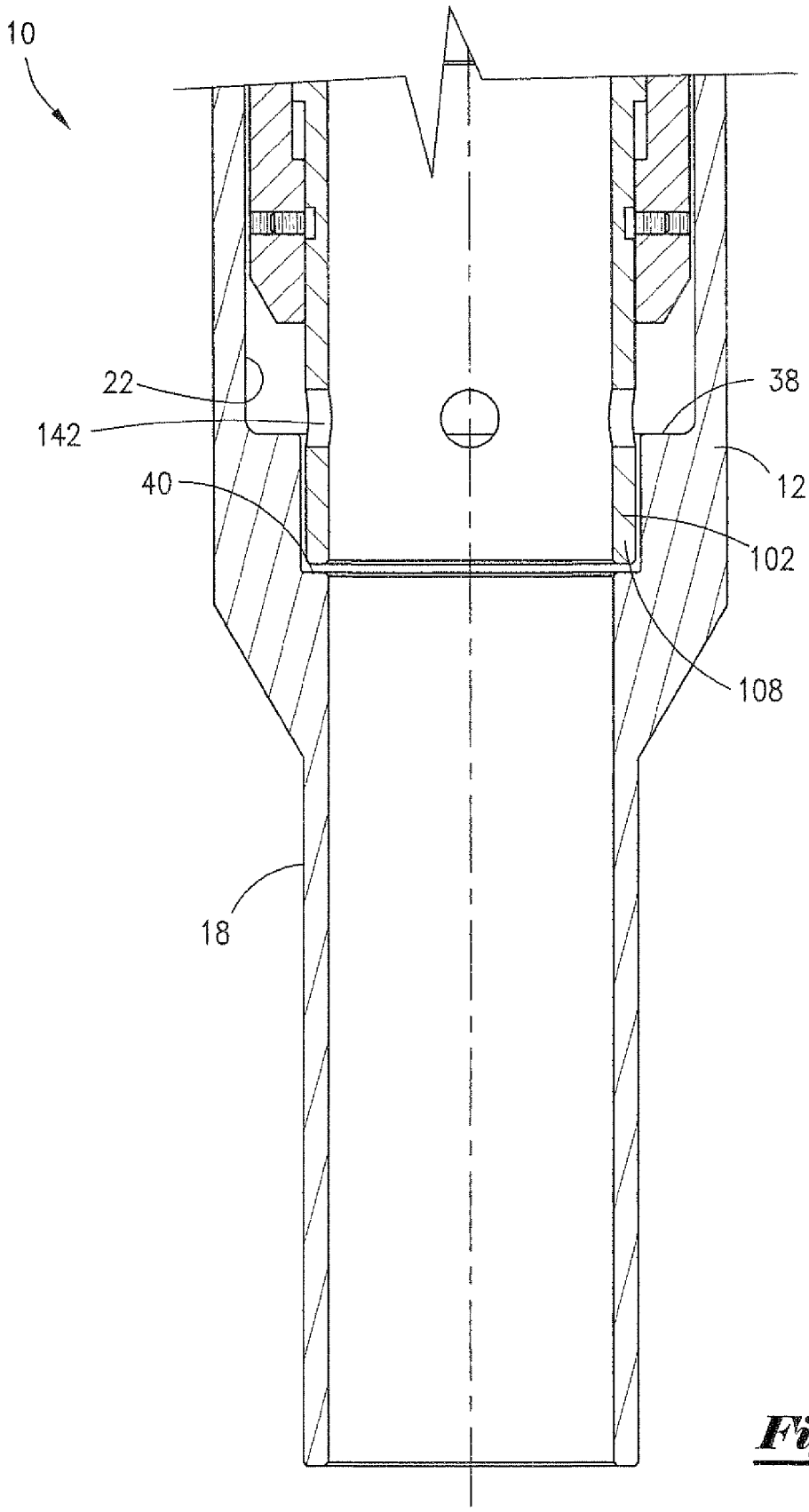
FIGS. 4A, 4B, 4C are a sequential cross-sectional side view of the embodiment of the present invention depicting a contingency shearing out of the plug and seat.
Figure 4B:
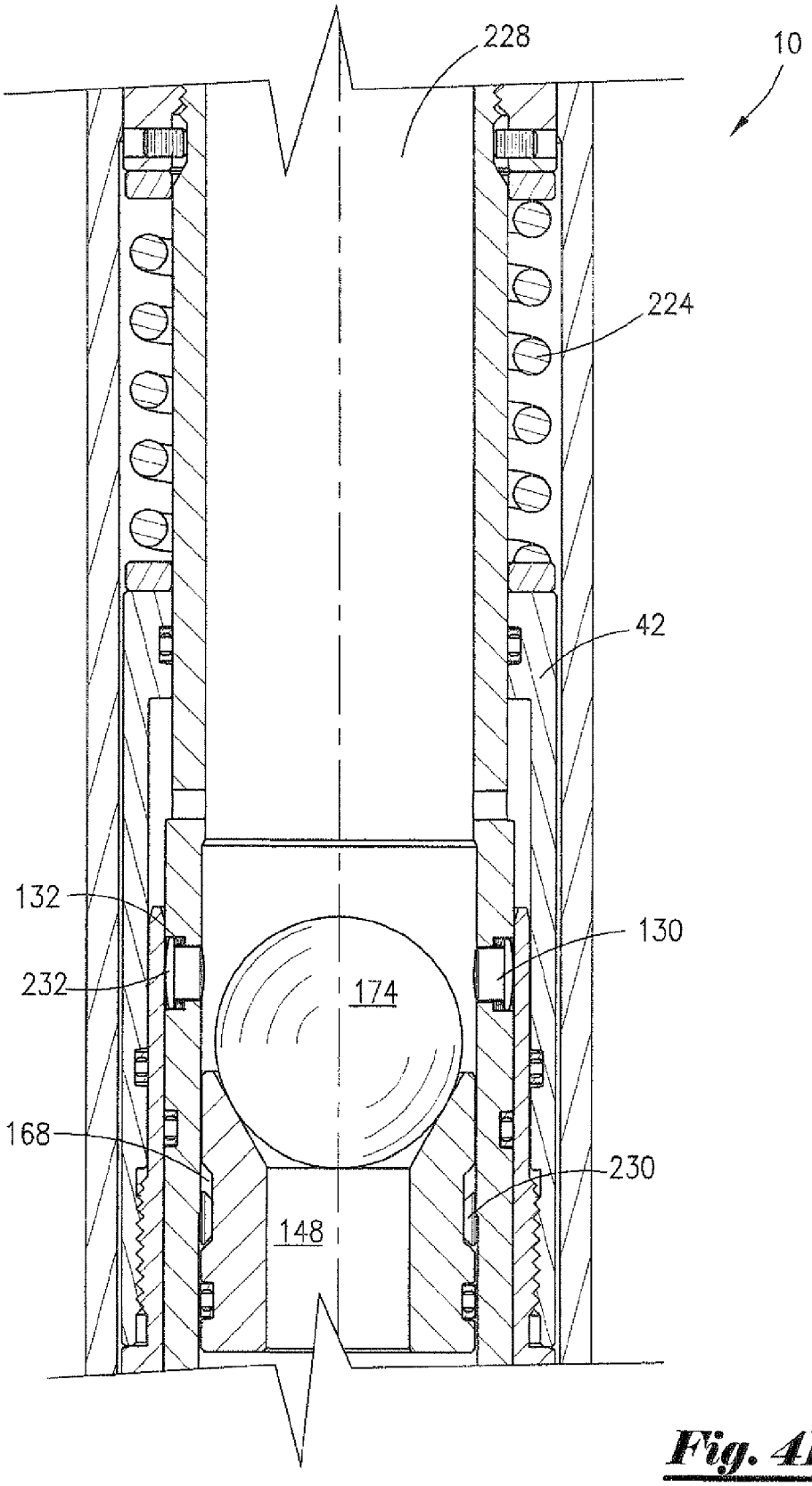
Figure 4C:
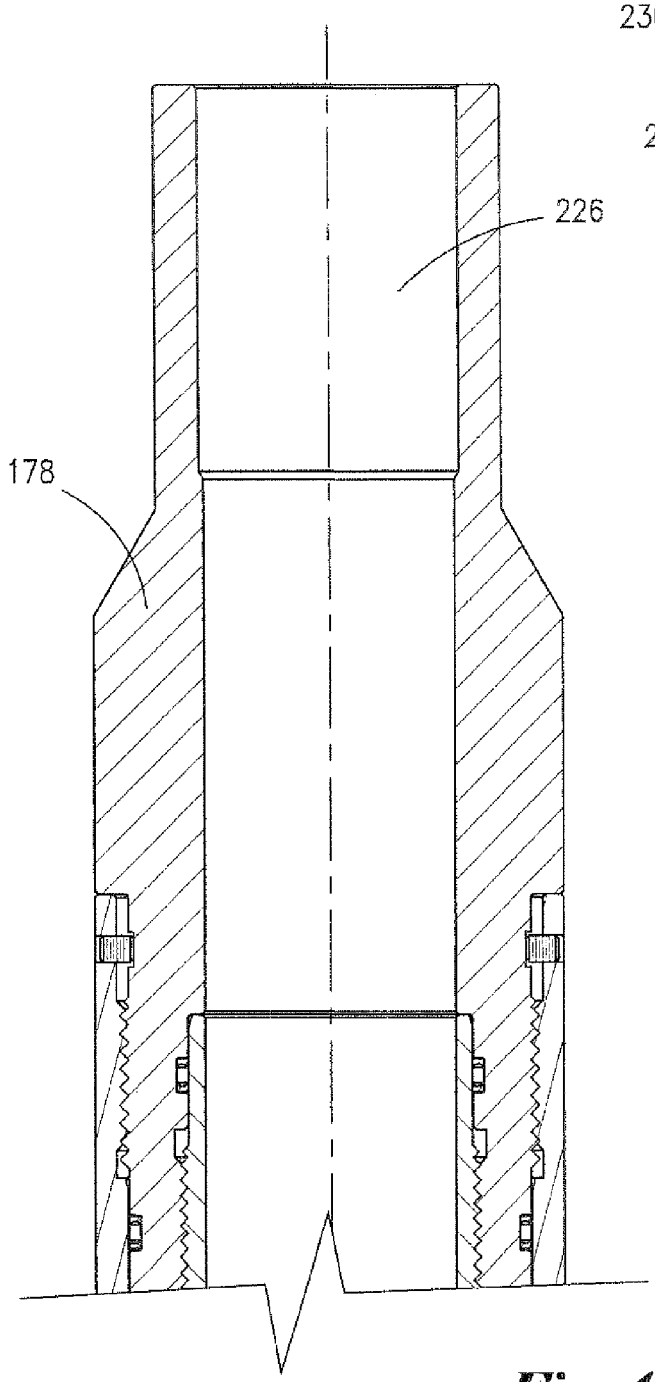

FIGS. 4A-4C show a backup procedure for removing plug 174 and seat 148. Should sub 10 lose its performance or seal integrity such that bleeding off the tubing pressure does not cause dislodgement of plug 174 and seat 148 from mandrel bore 228, it is possible to set down on seat 148 and shear dogs 130. This will release plug 174 and seat 148 which will fall down mandrel bore 228, well bore 226, and out the bottom end of the well tubing. The remnants of dogs 130 will be biased by biasing means 132 into sub 10 thereby eliminating any obstruction of mandrel bore 228 or well bore 226.

FIGS. 4A-4C also illustrate an alternative backup procedure for removal of plug 174 and seat 148. Should sub 10 lose the performance of piston 42 and upward movement, dog 130 may be sheared out by over pressure of seat 148 and plug 174.

Figure 5:
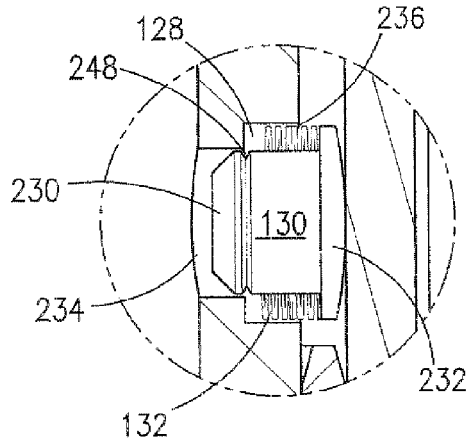
FIG. 5 is a cross-sectional side view of a dog of the embodiment of the present invention.

As shown in FIG. 5, dog 130 contains notch 248 that will cause dog 130 to shear out at a predetermined high-pressure or when sufficient force is physically exerted on dog 130.

Figure 6A:
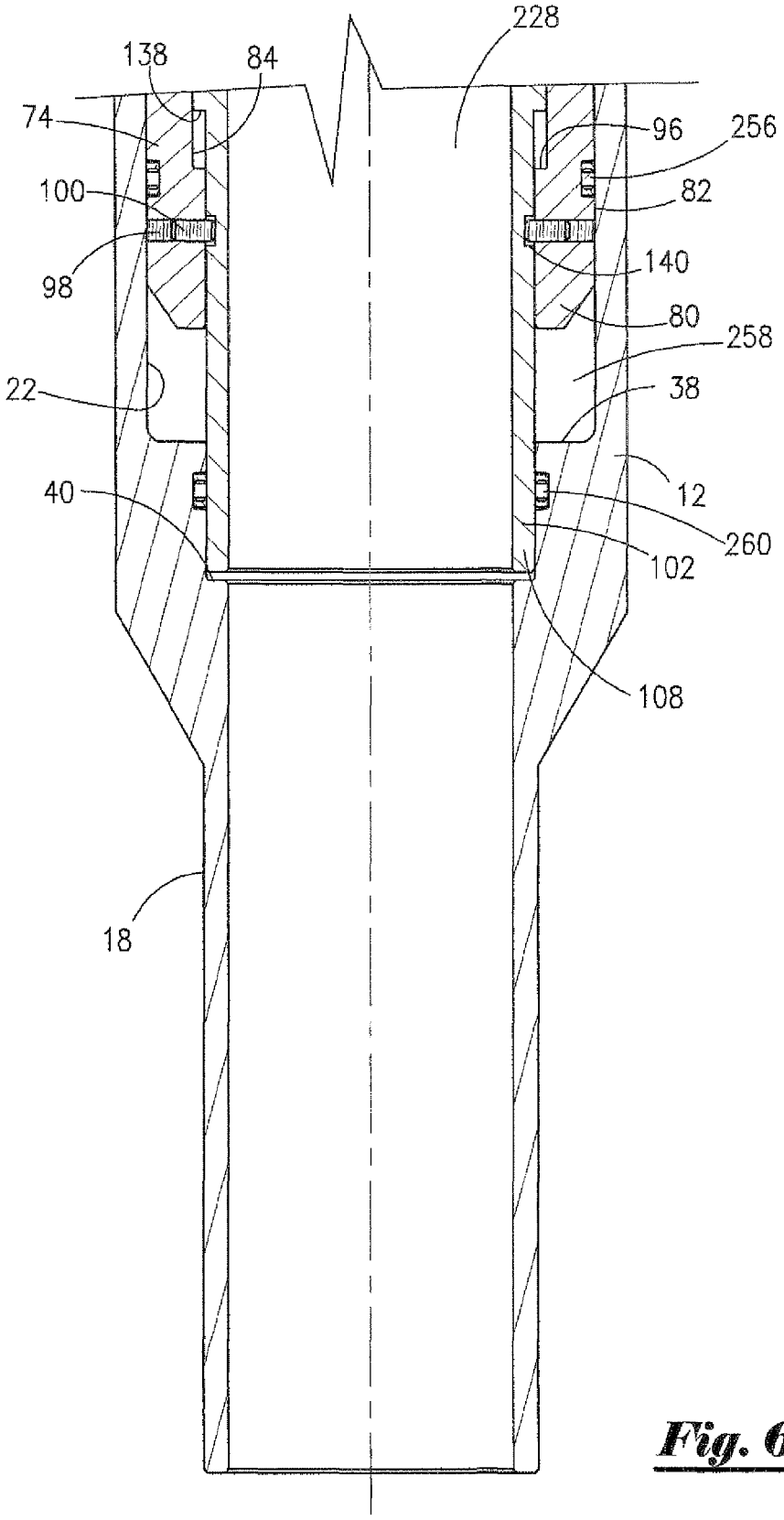
FIGS. 6A, 6B, and 6C are a sequential cross-sectional side view of an alternative embodiment of the present invention.
Figure 6B:
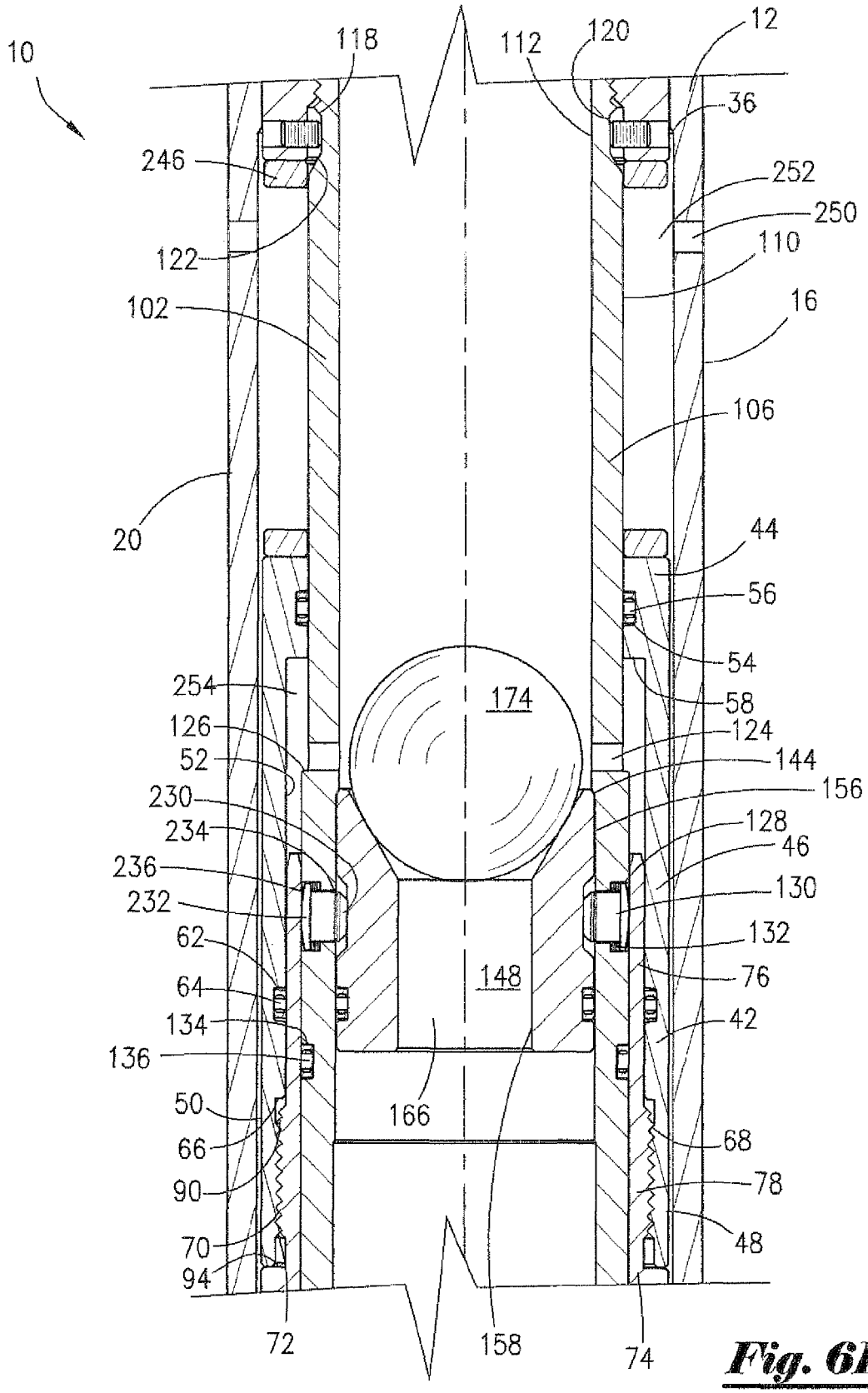
Figure 6C:
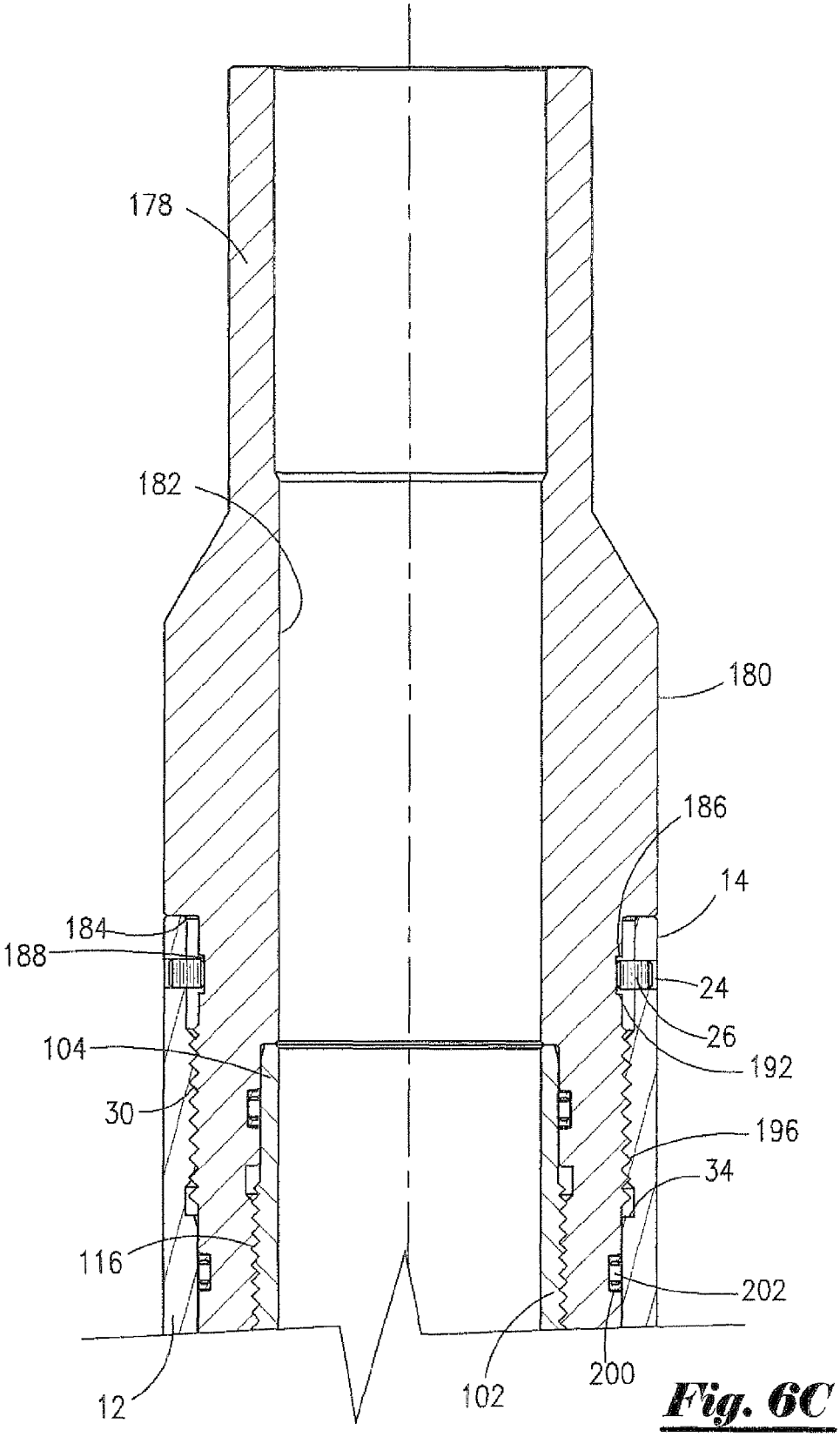

FIGS. 6A-6C show an alternative embodiment of sub 10. In this alternative embodiment, annulus port 250 is included in body 12. Annulus port 250 provides fluid communication of annulus fluid to annulus pressure chamber 252. Seal 256 forms a seal between outer surface 82 of sleeve 74 and inner surface 22 of body 12. Seal 260 forms a seal between inner surface 22 of body 12 and outer surface 110 of mandrel 102. Tubing pressure chamber 254 is included in sub 10. Sub 10 also has atmospheric pressure chamber 258 positioned between inner surface 22 of body 12 and outer surface 110 of mandrel 102. Atmospheric pressure chamber 258 sets below sleeve 74. Annulus pressure chamber 252 is slightly larger than tubing pressure chamber 254. In this configuration, sub 10 acts as an atmospheric chamber with the creation of atmospheric pressure chamber 258.

When the annulus pressure is greater than the tubing pressure, the force action in piston 42 will be in the downward direction. When the operator pressures up the tubing pressure to a predetermined pressure, the force action in piston 42 will be in the upward direction causing shears pins 100 to shear thus permitting piston 42 to move upward. When the operator bleeds the tubing pressure to within 500 PSI positive tubing pressure, piston 42 will start to move downward due to the annulus pressure on piston 42 and the atmospheric chamber. When piston 42 bottoms out, dogs 130 will become unsupported and bias outward thereby releasing seat 148 and plug 174.

Sub 10 does not surge the formation when blowing out seat 148. Sub 10 is also capable of mechanical override. It has elastomeric and non-elastomeric capabilities. Connections can also be metal to metal sealing. Sub 10 has an anti-surge feature that shears up. It also is capable of bleeding tubing pressure before releasing seat 148. Dog 130 system can also be sheared out at a high shear rate as a backup. Sub 10 has a small OD to accommodate dual packer applications. Both a ball or dart plug 174 system can be used. If a dart is used, the dart will hold formation pressure from below or tubing pressure from above with a locking dart.

Sub 10 may be used below any down-hole tool to pressure up against. With sub 10, tubing pressure may be pressured up more than one time or a plurality of times on sub 10 to manipulate the well tool above sub 10. Also with sub 10, tubing pressure may be pressured up multiple times to manipulate the well tool or tools positioned above sub 10.

While preferred embodiments of the present invention have been described, it is to be understood that the embodiments described are illustrative only and that the scope of the invention is to be defined solely by the appended claims when accorded a full range of equivalents, many variations and modifications naturally occurring to those skilled in the art from a perusal hereof.

What is claimed is:

1. A formation saver sub, comprising:

a tubular body including an upper section, a middle section, a lower section, an outer surface, and an inner surface;

a mandrel including an upper section, a middle section, a lower section, an outer surface and an inner surface defining a mandrel bore, said mandrel being positioned interior of said body;

a piston including an upper section, a middle section, a lower section, an outer surface, and an inner surface, said piston positioned between said inner surface of said body and said outer surface of said mandrel;

a seat including an upper section, a middle section, a lower section, an outer surface, and an inner surface defining a seat bore, said seat releasably positioned in said mandrel bore, said upper section of said seat adapted to receive a plug;

wherein said piston is actuated in a first direction in response to an increase in a fluid pressure, said actuation in said first direction maintains said positioning of said seat in said mandrel bore; and wherein said piston is actuated in a second direction in response to a bleed off of said fluid pressure, said actuation in said second direction releases said seat from said mandrel bore.

2. The formation saver sub according to claim 1, wherein said fluid pressure is a tubing pressure in said mandrel bore and wherein said actuation of said piston in said first direction occurs when said tubing pressure is increased to a range between 1500 PSI and 10000 PSI.

3. The formation saver sub according to claim 2, wherein said actuation of said piston in said second direction occurs when said tubing pressure is bled off to a range between 100 PSI and 1000 PSI.

4. The formation saver sub according to claim 3, wherein said tubing pressure is bled off to about 500 PSI.

5. The formation saver sub according to claim 3, wherein said piston is actuated in said second direction by an expansion force.

6. The formation saver sub according to claim 5, wherein said expansion force is a mechanical expansion force.

7. The formation saver sub according to claim 6, wherein said mechanical expansion force is produced by a spring.

8. The formation saver sub according to claim 6, wherein said expansion force is a fluid pressure force.

9. The formation saver sub according to claim 8, wherein said fluid pressure force is produced by an annulus fluid pressure.

10. The formation saver sub according to claim 1, wherein said upper section of said tubular body is adapted for connection to a well tubing, said well tubing including a well tubing bore; and wherein said upper section of said mandrel is adapted for connection to said well tubing.

11. The formation saver sub according to claim 10, further comprising:

a sleeve including an upper section, a middle section, a lower section, an outer surface and an inner surface, said sleeve connected to said piston, said sleeve positioned between said inner surface of said body and said outer surface of said mandrel;

a shear means detachably affixing said sleeve to said mandrel;

a spring means positioned between said inner surface of said body and said outer surface of said mandrel, said spring means being in cooperative engagement with said piston;

wherein said actuation of said piston in said first direction shears said shear means thereby detaching said sleeve from said mandrel and moving said piston and sleeve upward to compress said spring means;

wherein said actuation of said piston in said second direction includes an expansion of said spring means to move said piston and sleeve downward to a position that results in said release of said seat from said mandrel bore.

12. The formation saver sub according to claim 11, wherein said piston includes a fluid chamber.

13. The formation saver sub according to claim 12, wherein said mandrel includes a passage for fluid communication between said mandrel bore and said fluid chamber of said piston.

14. The formation saver sub according to claim 11, wherein said shear means includes one or more shear pins.

15. The formation saver sub according to claim 11, wherein said plug is a ball or dart.

16. The formation saver sub according to claim 10, further comprising:

an annulus port in said tubular body;

an annulus pressure chamber positioned between said inner surface of said body and said outer surface of said mandrel, said annulus pressure chamber in fluid communication with said annulus port;

an atmospheric pressure chamber positioned between said inner surface of said body and said outer surface of said mandrel;

a tubing pressure chamber in said piston;

a sleeve including an upper section, a middle section, a lower section, an outer surface and an inner surface, said sleeve connected to said piston, said sleeve positioned between said inner surface of said body and said outer surface of said mandrel;

a shear means detachably affixing said sleeve to said mandrel;

wherein said annulus pressure chamber and said atmospheric pressure chamber are separated by said piston and sleeve;

wherein said actuation of said piston in said first direction includes increasing a tubing pressure in said tubing pressure chamber to exert a sufficient force on said piston to cause a shearing of said shear means thereby detaching said sleeve from said mandrel and moving said piston and sleeve upward into said annulus pressure chamber;

wherein said actuation of said piston in said second direction includes exerting a sufficient force generated by an annulus fluid pressure in said annulus pressure chamber on said piston to move said piston and sleeve downward to a position that results in said release of said seat from said mandrel bore.

17. A method of actuating a well tool connected to a well tubing, comprising the steps of:

(a) connecting a formation saver sub to said well tubing below said well tool; said formation saver sub comprising:

a tubular body including an upper section, a middle section, a lower section, an outer surface, and an inner surface;

(ii) a mandrel including an upper section, a middle section, a lower section, an outer surface and an inner surface defining a mandrel bore, said mandrel being positioned interior of said body;

(iii) a piston including an upper section, a middle section, a lower section, an outer surface, and an inner surface, said piston positioned between said inner surface of said body and said outer surface of said mandrel;

(iv) a seat including an upper section, a middle section, a lower section, an outer surface, and an inner surface defining a seat bore, said seat releasably positioned in said mandrel bore, said upper section of said seat adapted to receive a plug;

(b) sealing said well bore above said seat by dropping said plug through said well bore to said mandrel bore wherein said plug seats in said upper section of said seat;

(c) manipulating said well tool;

(d) increasing a fluid pressure in said well bore to a first level that causes said piston to move in a first direction that maintains said positioning of said seat in said mandrel bore; and (e) bleeding off said fluid pressure in said well bore to a second level that causes said piston to move in a second direction that releases said seat from said mandrel bore.

18. The method according to claim 17, wherein said fluid pressure is a tubing pressure and wherein said first level of said tubing pressure is in the range of 1500 PSI to 10000 PSI.

19. The method according to claim 18, wherein said second level of said tubing pressure is in the range of 100 PSI to 1000 PSI.

* * * * *